US006446371B2

(12) United States Patent
Wehrwein

(10) Patent No.: US 6,446,371 B2
(45) Date of Patent: Sep. 10, 2002

(54) CLOTHES PRESSING IRON SOLEPLATE

(75) Inventor: Axel Wehrwein, Rossdorf (DE)

(73) Assignee: Rowenta Werke GmbH, Offenbach (DE)

( * ) Notice: Subject to any disclaimer, the term of this patent is extended or adjusted under 35 U.S.C. 154(b) by 0 days.

(21) Appl. No.: 09/750,191

(22) Filed: Dec. 29, 2000

(30) Foreign Application Priority Data

Dec. 29, 1999 (FR) ..... 99 16688

(51) Int. Cl.[7] ..... D06F 75/38
(52) U.S. Cl. ..... 38/93
(58) Field of Search ..... 38/93; 148/138; 72/53

(56) References Cited

U.S. PATENT DOCUMENTS 2,750,691 A 6/1956 Parr
3,333,955 A * 8/1967 Walker et al. ..... 38/93
4,665,637 A * 5/1987 Kramer ..... 39/93
4,862,609 A * 9/1989 Ullrich et al. ..... 38/93

FOREIGN PATENT DOCUMENTS

EP 0 726 351 A1 8/1996
FR 2 567 929 1/1986

* cited by examiner

*Primary Examiner*—Ismael Izaguirre
(74) *Attorney, Agent, or Firm*—Browdy and Neimark

(57) ABSTRACT

A steel or stainlees steel soleplate for a pressing iron having a working surface that will be in contact with articles to be pressed when the pressing iron is in use. The soleplate has, at the working surface, crystal grains that have been deformed by compression applied perpendicular to the working surface, the number of dislocations per unit of volume being at least 40% greater than that of the metal at the interior of the soleplate.

11 Claims, 3 Drawing Sheets

CLOTHES PRESSING IRON SOLEPLATE

BACKGROUND OF THE INVENTION

The present invention relates to electric clothes pressing irons having a soleplate composed of a metal sheet possibly bent up at its edges and having a lower face that constitutes, with the exterior of the edges, the working face in contact with the articles to be ironed when the iron is in its ironing position. Generally, such iron further include a heating body associated with the soleplate, the heating body most often being made of aluminum and including the heating element of the iron.

Soleplates of pressing irons desirably have an attractive appearance, and must have a good resistance to corrosion, good sliding properties with respect to fabrics to be ironed, and a surface hardness which causes them to resist scratching. Resistance to scratching is necessary to maintain the sliding qualities and to resist adverse effects of inappropriate uses, such as for example a passage of the iron over a zipper.

For this purpose, numerous surface treatments have already been proposed. For example, it is known to cover soleplates of aluminum or steel with an enamel coating. It is also known to coat the soleplate surface with a ceramic by plasma spraying as in the European patent document EP 227111, or by any other procedure such as, for example, by anodization as described in the French patent document FR 2717833. It has also been proposed to perform chemical surface treatments, such as a treatment with phosphates which improves corrosion resistance and aids sliding. It is also known to coat the soleplate with a product such as polytetrafluoroethylene.

The European patent document EP 726351 describes a process that is particularly adapted to aluminum soleplates, in which both surfaces are treated by "shot peening", which is a treatment in which the surfaces are subjected to a jet of particles driven in an air jet, for the sole purpose of improving the flatness, or planarity, of the surface. To achieve the desired result, both surfaces must be treated simultaneously and symmetrically.

These treatments are particularly useful on soft surfaces, such as aluminum surfaces, or steel surfaces to also protect them from corrosion. French patent document FR 2567929 discloses an aluminum surface reinforced by a stainless steel plate. The stainless steel surfaces do not corrode easily, have an attractive appearance, which can be provided by a shiny finish, and have acceptable sliding properties. Most often they can be used without a surface treatment, other than a possible finishing polish.

However, stainless steel, although more resistant to scratching, remains all the same subject to scratching, and the finish can be deteriorated, which requires that the soleplates be protected at the point of sale by a plastic film. In addition, it is desirable to improve the coefficient of sliding friction of the soleplate on the fabric to be ironed.

BRIEF SUMMARY OF THE INVENTION

The present invention provides a clothes pressing iron having a metal soleplate with a working surface of steel, preferably of stainless steel, having an improved coefficient of friction and an improved hardness to improve the resistance to scratching and to improve the ease with which the soleplate slides on the fabric.

Primarily, the invention provides a metal soleplate for a pressing iron in which the working surface of the soleplate is composed of crystalline grains that are deformed by compression perpendicular to the surface, the number of metal grain dislocations per unit of volume being at least 40% greater than that of the metal at the interior of the soleplate. For this purpose, only the lower surface of the soleplate, which is the surface that will contact the articles being ironed, need be subjected to such deformation.

Metal dislocations are understood to be discontinuities in the crystalline metal structure, whether these are between metal grains or constituted by defects, or discontinuities, within the grains.

The interior of the soleplate is here defined as a region of the metal that is remote from the surfaces, to a depth greater than 40 $\mu$m.

The compression of the surface causes it to be smoothed, reduces the coefficient of friction of the surface on the fabric to be ironed and closes pores which might be preexisting. The compression also increases the hardness and creates internal stresses that enable the exterior surface to resist damage.

Preferably, the thickness of the compressed part of the metal, measured from the surface, is between 25 and 35 $\mu$m.

This thickness varies according to the control of the mode of producing the compression. It is preferred to select a compromise between a high level of hardness, which necessitates a compression to a great depth but where a correct surface state is difficult to obtain, and a good surface state, which promotes sliding.

Preferably, the soleplate is made of stainless steel and has at its working surface a Vickers hardness at least 25% greater than the Vickers hardness measured at the interior of the soleplate.

The hardness at the interior of the soleplate is that which exists in a metal zone situated at a depth of the metal soleplate beyond the compressed region. It is equal to the hardness of the metal before the compression treatment.

For example, the surface of a stainless steel plate having a Vickers hardness of less than 400 at the interior has a Vickers hardness greater than 500 at the surface, or a minimum increase in hardness of 25%.

Preferably, the roughness of the working surface, measured according to the standard DIN 4777, is less than 3 $\mu$m.

One thus obtains a metal soleplate having a good resistance to scratching and a good slidability on the fabric.

Preferably, compression of the surface of the stainless steel is obtained by a "shot peening" process.

This process includes the projection of essentially non-abrasive particles onto the soleplate surface by entraining the particles in a jet of expanded air, the air being, prior to expansion, placed at a pressure of the order of 2 bars. Hammering of the surface by the particles produces the desired compression of the metal grains of the stainless steel. The cloud of particles produces a very regular effect and is much easier to control than does compression by rolling, for example. This process is applied equally to the edges of the soleplate in a more convenient manner than other mechanical processes.

Preferably, the treatment of the surface by shot peening is effectuated in a single operation.

In particular there is no preliminary abrasion, or thermal treatment of the stainless steel. The projection, or spraying, is performed at normal room temperature. This permits a less costly treatment.

Preferably, the particles utilized are a mixture of glass beads, ceramic beads and natural granular materials.

This mixture permits controlling the hammering of the surface by producing different impacts that result in a smoothing of the surface as well as a deformation to a certain depth below the surface.

BRIEF DESCRIPTION OF THE DRAWING

The invention will be better understood from the example presented herebelow in conjunction with the attached drawings.

DETAILED DESCRIPTION OF THE INVENTION

Figure 1:
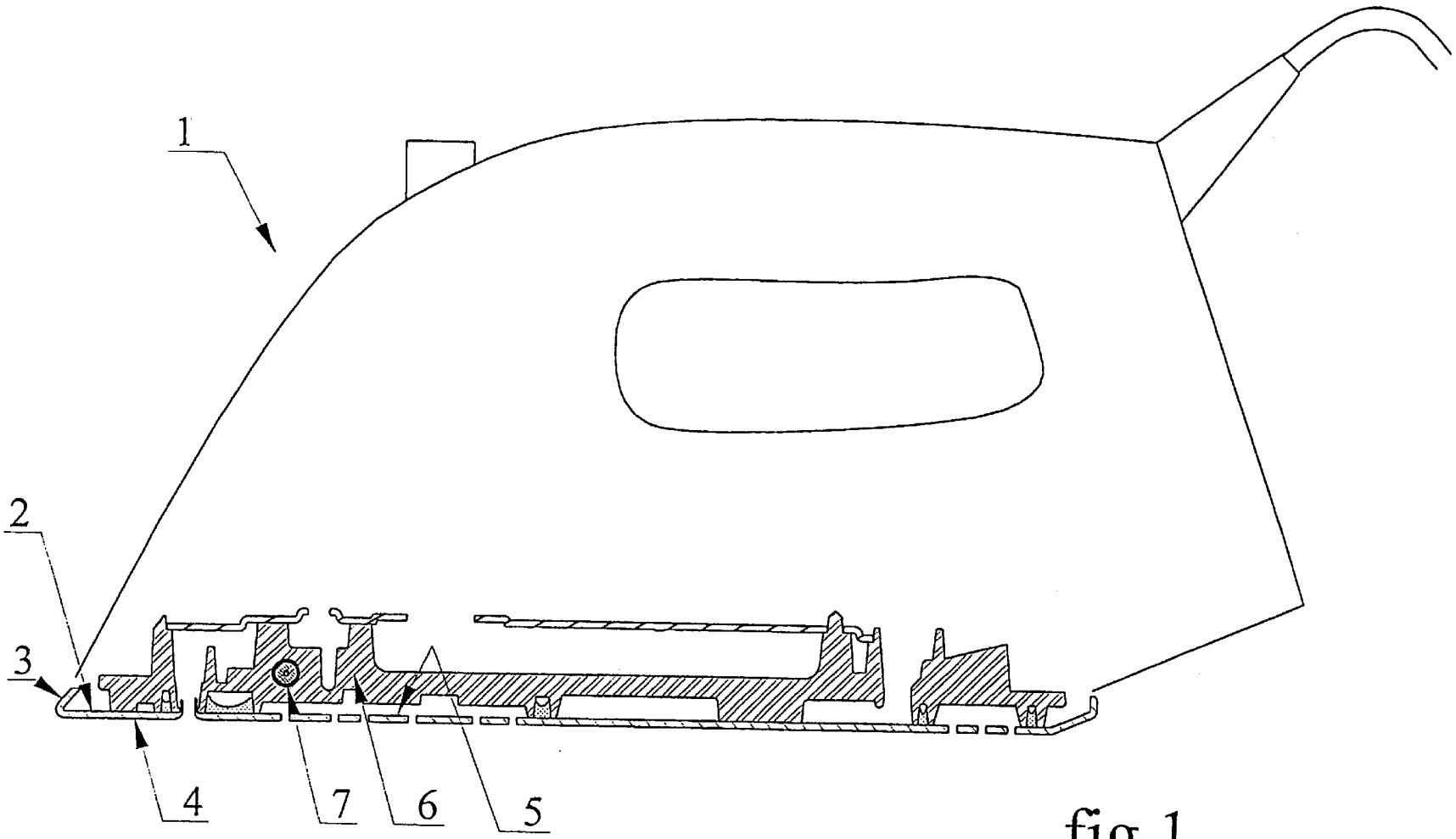
FIG. 1 is a side elevational view, partly in cross section, of a pressing iron produced according to the invention.

FIG. 1 illustrates an exemplary embodiment of the invention forming part of a steam pressing iron 1 that includes a soleplate 2 according to the invention made of a sheet of stainless steel having a thickness of around 0.5 mm. Soleplate 2 is bent up at its edges 3. The flat lower face 4, and to a lesser extent the edges 3, will be in contact with fabric articles during ironing and constitute the working surface of iron 1. Soleplate 2 is in intimate contact via its upper face 5 with a heating block 6 provided with a heating element 7 in a manner that is already well known in the art.

Figure 3:
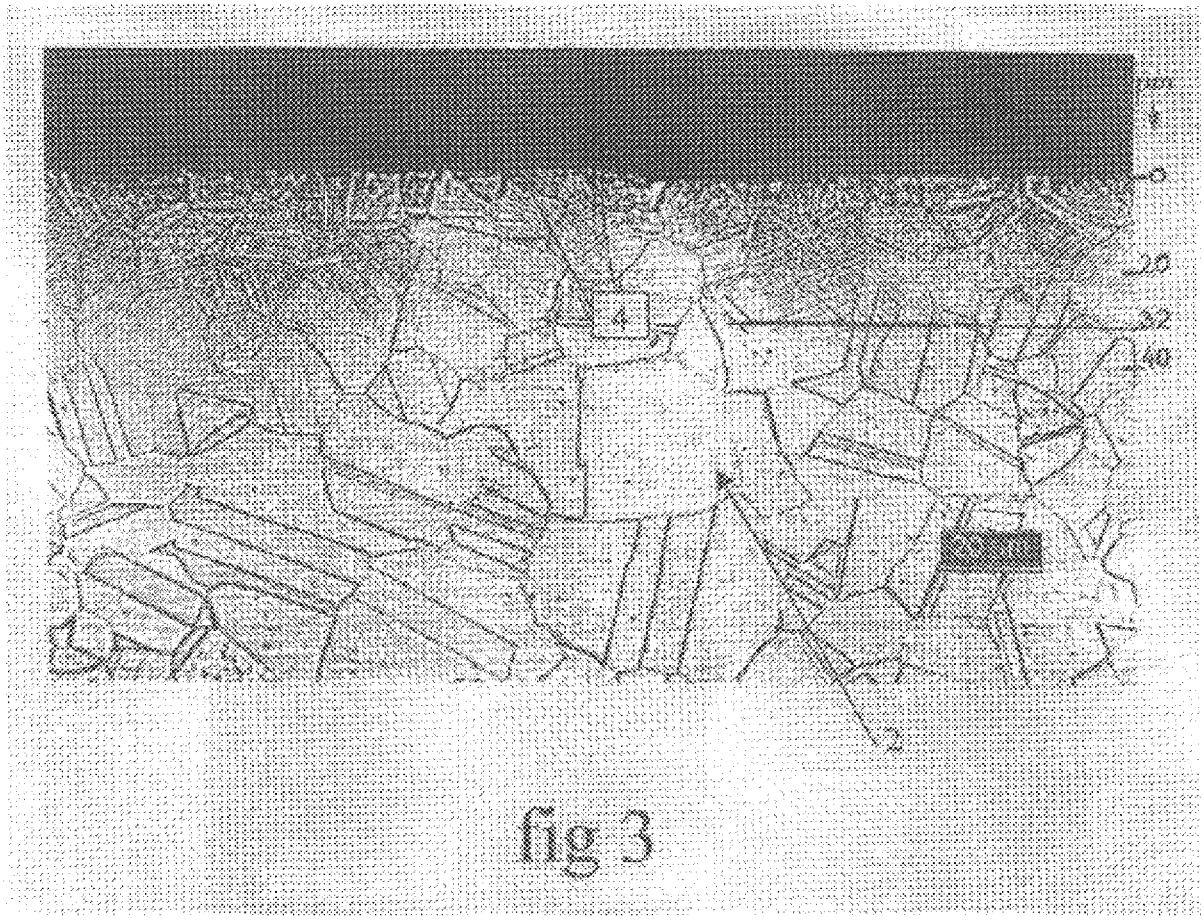
FIG. 3 is a micrographic cross section of a soleplate treated according to the invention in the vicinity of its working surface.

A micrographic cross section of a sample of soleplate 2 obtained by an electron microscope is shown in FIG. 3, in which the black strip at the upper edge is the background of the sample that was studied. As can be seen, starting from the working surface 4 there is a zone where the crystalline grains of the stainless steel are deformed and compressed, this zone extending to a depth of 30–32 $\mu$m from surface 4.

In immediate proximity to surface 4 it can be seen that the density of the dislocations is substantially one and one-half (1.5) times that which can be measured toward the interior of the soleplate.

The roughness obtained in this example is on the order of 2 $\mu$m. A lesser roughness could be achieved by employing a longer treatment time or a less intense compression action.

Figure 2:
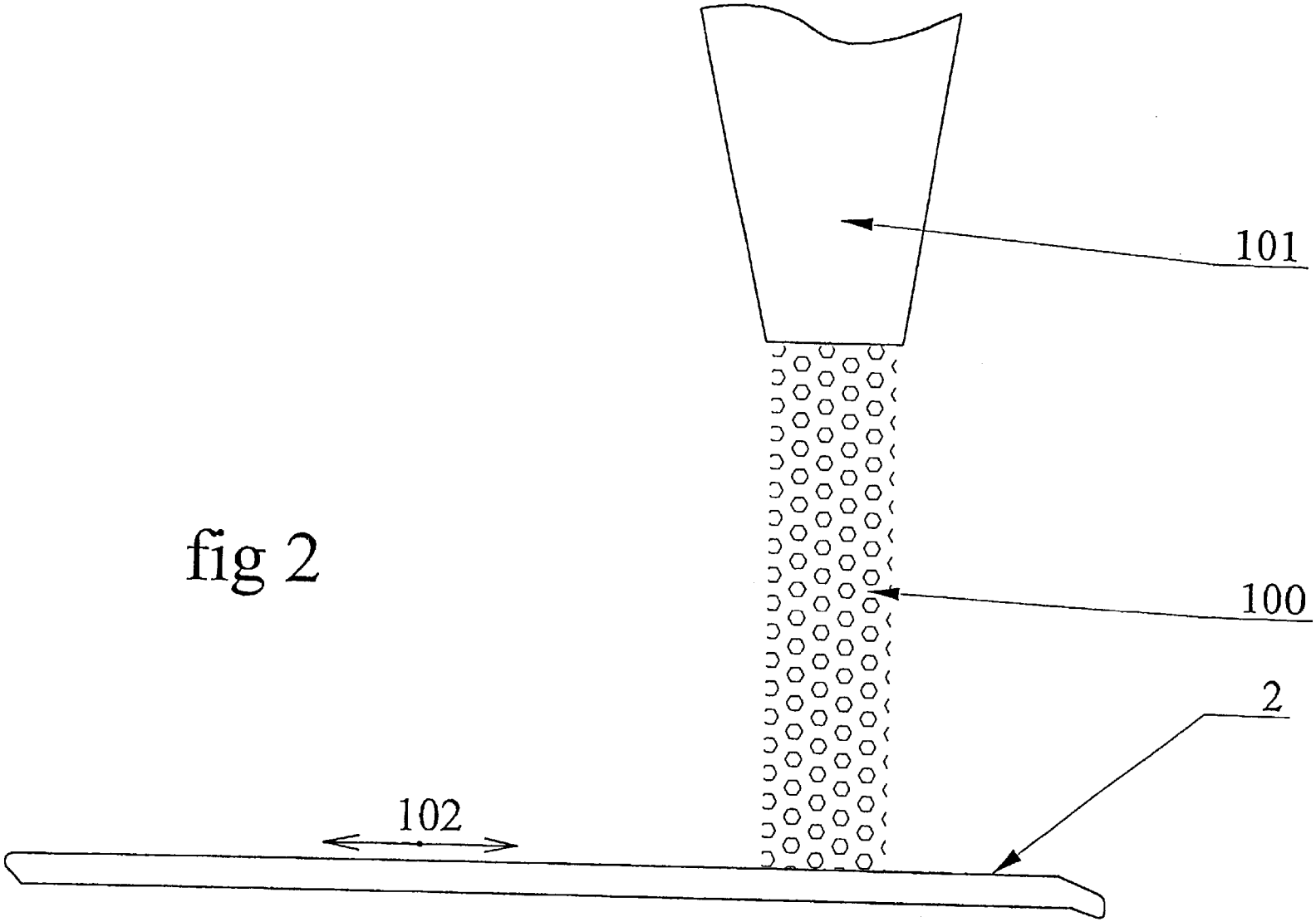
FIG. 2 is a simplified pictorial illustration of the performance of a process according to the invention to produce a compressed zone at the surface of the soleplate.

In a preferred version of the invention, in order to obtain this type of result and as shown in FIG. 2, soleplate working surface 4 is brought, after forming the edges and steam outlet holes, under a jet of particles 100 transported by a jet of air issuing, with particles 100, from a nozzle 101. Nozzle 101 is at a small distance, around 100 mm, from soleplate 2. At the same time, soleplate 2 is displaced parallel to the plane of working surface 4 as represented by arrows 102, as well as in a direction perpendicular to those arrows, in a manner such that the jet impacts on the entire surface of soleplate 2. According to another version, the jet of particles 100 can be in the form of a sheet formed by several nozzles disposed adjacent one another, perpendicular to the plane of FIG. 2, the width of this sheet being equal to or greater than the width of the soleplate. Displacement of the soleplate, or of the nozzles, then takes place only in the direction of the length of soleplate 2.

In order to compensate for deformations due to the surface compression of the metal, the lower surface of the sole plate is made slightly concave during its initial forming so that after treatment it will be applied properly against heating body 6. In a preferred version, the mixture of particles comprises a majority of glass beads, with a complement of ceramic beads, for example of aluminum oxide or zirconium oxide, and of ground organic particles for example nut shells, almonds, coconuts. This mixture permits obtaining a smooth and hard surface in a single operation at normal room temperature and without any particular preparation of the sole plate.

In this manner, one obtains a stainless steel surface having a good appearance, a hardness permitting it to better resist scratching, and the ability to slide on fabrics like the best known coatings.

In an unexpected manner, it is noted that the utilization of particles of organic material permits injection, into residual microcracks formed by the compression procedure, of vegetable oil compounds that add to the improvement of the sliding action of the soleplate.

This application relates to subject matter disclosed in French Application Number 99 16688, filed on Dec. 29, 1999, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. Metal soleplate for a pressing iron having a working surface that will be in contact with articles to be pressed when the pressing iron is in use, wherein the metal of said soleplate is stainless steel, and said soleplate has, at said working surface, crystal grains that have been deformed by compression applied perpendicular to the working surface, the number of dislocations per unit of volume being at least 40% greater than that of the metal at the interior of said soleplate.

2. The metal soleplate of claim 1 wherein the metal is compressed over a thickness of 25–35 micrometers from the working surface.

3. The metal soleplate of claim 2 wherein said soleplate has a working surface with a Vickers hardness at least 25% greater then the Vickers hardness measured at the interior of said soleplate beneath the surface having grains deformed by the compression.

4. The metal soleplate of claim 3 wherein the working surface of said soleplate has a roughness, measured according to the standard DIN 4777, which is less then 3 $\mu$m.

5. The metal soleplate of claim 1 wherein the deformation of the crystal grains by compression is achieved by a shot peening process.

6. The metal soleplate of claim 5 wherein the shot peening process is effectuated in a single operation.

7. Metal soleplate for a pressing iron having a working surface that will be in contact with articles to be pressed when the pressing iron is in use, wherein the metal of said soleplate is steel or stainless steel, and said soleplate has, at said working surface, crystal grains that have been deformed by compression applied perpendicular to the working surface, the number of dislocations per unit of volume being at least 40% greater than that of the metal at the interior of said soleplate, wherein the shot peening process is effectuated in a single operation and is carried out with particles of a material including at least one of glass beads, ceramic beads and natural organic granular materials.

8. The metal soleplate of claim 1 wherein only said working surface of said soleplate has been deformed by compression.

9. A process for treating a metal soleplate of a pressing iron, the soleplate having a working surface that will be in contact with articles to be pressed when the pressing iron is in use, wherein the metal of said soleplate is stainless steel, said process comprising deforming a portion of the soleplate metal at the working surface by a compression force applied perpendicular to the working surface to produce a number of crystal grains dislocations per unit of volume that is at least 40% greater than the number of crystal grain dislocations at the interior of the soleplate.

10. The process according to claim 9 wherein said process of deforming is carried out by shot peening.

11. The process of claim 9 wherein said step of deforming is performed only on the working surface.

* * * * *